United States Patent [19]

Newlon

[11] 4,000,540

[45] Jan. 4, 1977

[54] SPRING LOADED, ADJUSTABLE WALKING DOOR HINGE

[75] Inventor: Robert L. Newlon, Sterling, Ill.

[73] Assignee: Lawrence Brothers, Inc., Sterling, Ill.

[22] Filed: Apr. 19, 1976

[21] Appl. No.: 678,139

[52] U.S. Cl. ..... 16/151

[51] Int. Cl.[2] ..... E05D 7/08

[58] Field of Search ..... 16/151–153, 16/130, 49, 176, 180, 185 R, 185 H, 168, 179; 74/55, 56, 567, 569; 160/206

[56] References Cited

UNITED STATES PATENTS

| | | | |
|---|---|---|---|
| 3,391,723 | 7/1968 | Kirby | 16/151 X |
| 3,866,658 | 2/1975 | Smith | 16/151 X |
| 3,895,412 | 7/1975 | Johnson | 16/151 |

*Primary Examiner*—G. V. Larkin
*Attorney, Agent, or Firm*—Olson, Trexler, Wolters, Bushnell & Fosse, Ltd.

[57] ABSTRACT

Two door pivot units are provided for causing radially outward or walking door motion when the door undergoes angular opening motion. In a first pivot unit, a cam follower is pushed with increasing force against a cam as the door opens by an adjustable biasing device. In a second unit, an arrowhead-shaped cam causes radially outward door movement similar to the motion caused by the first unit.

29 Claims, 12 Drawing Figures

FIG. 1
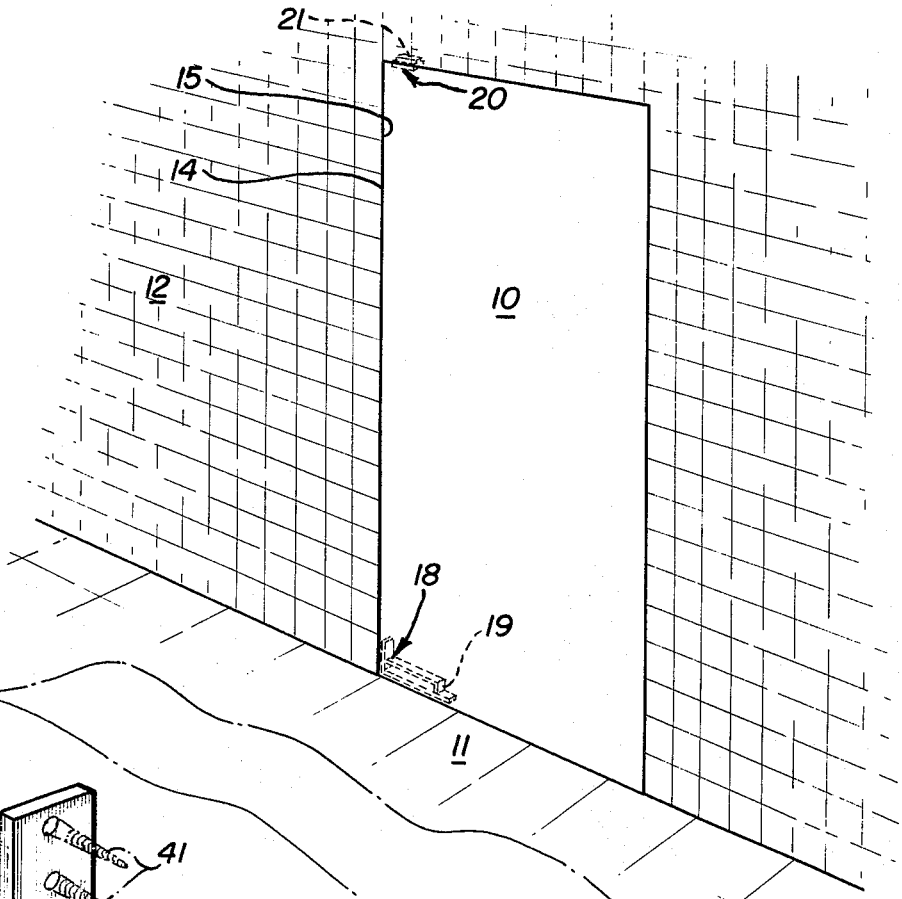
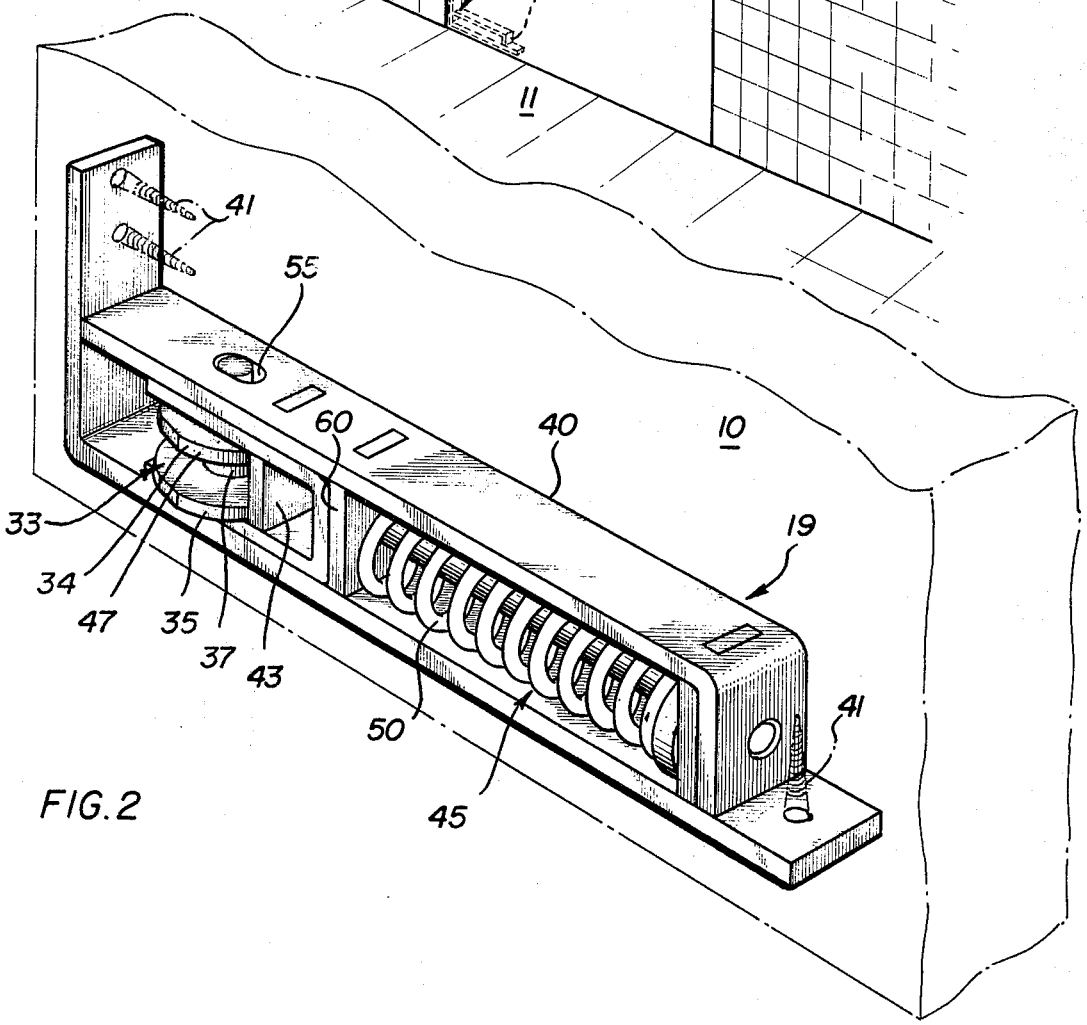
FIG. 2

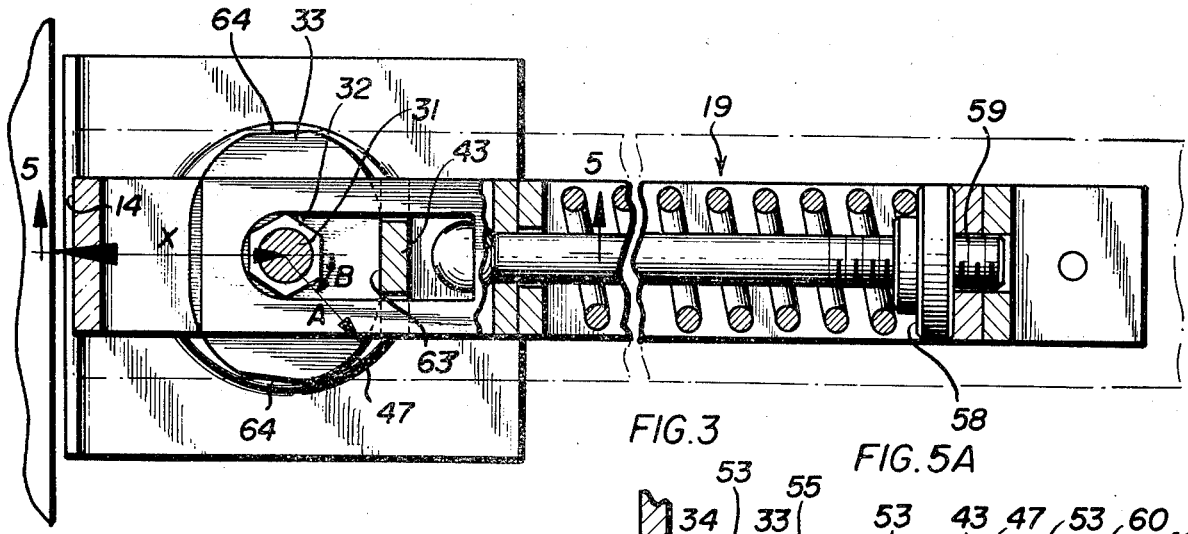
FIG.3
FIG.5A
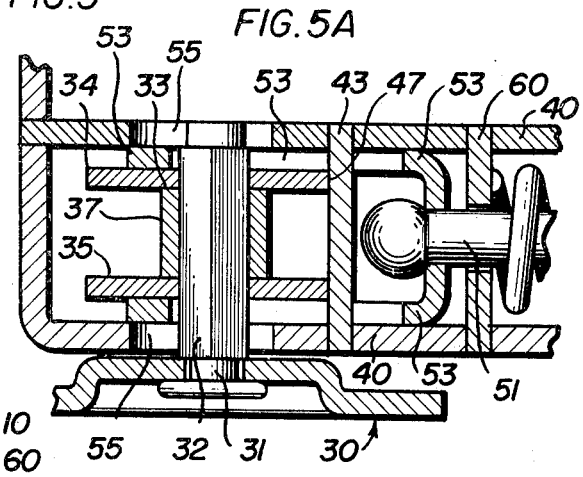
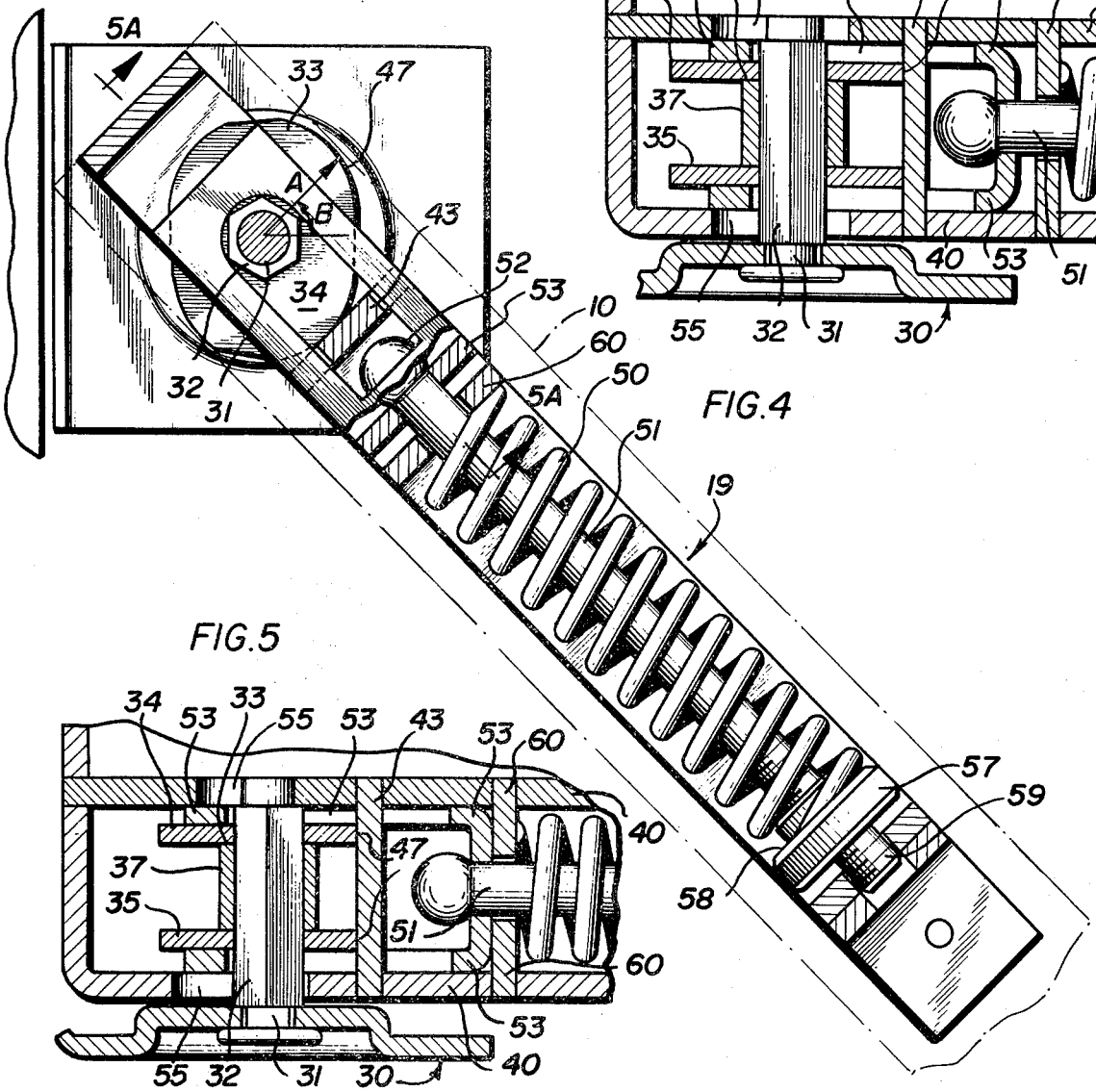
FIG.4
FIG.5

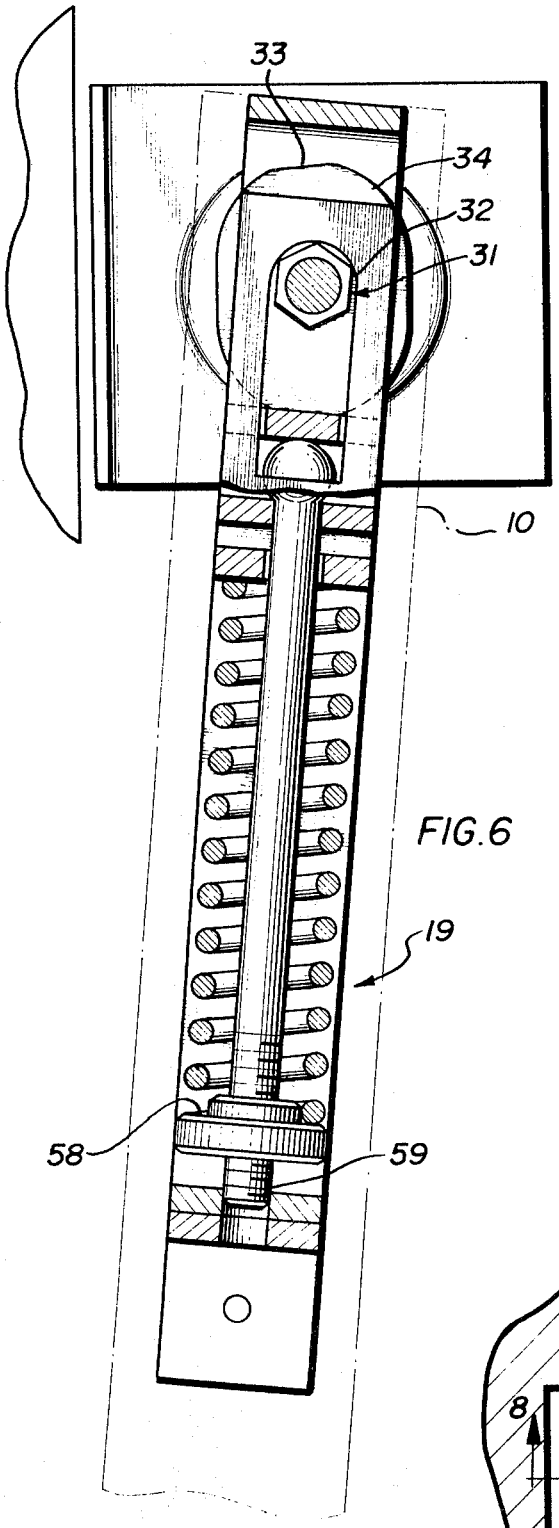
FIG.6
FIG.8
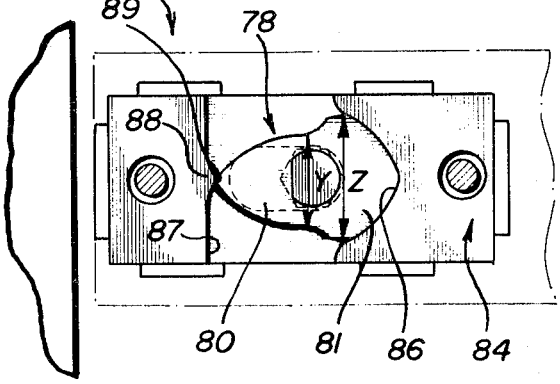
FIG.9
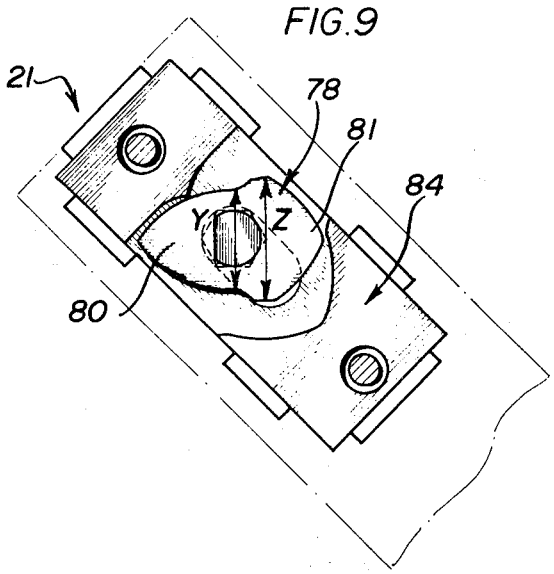
FIG.7
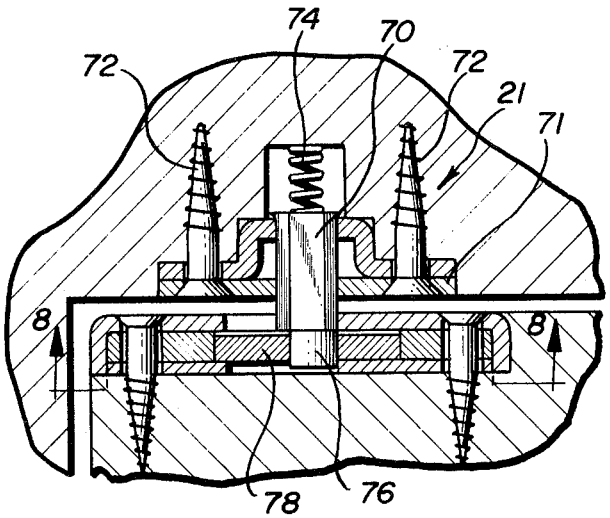

SPRING LOADED, ADJUSTABLE WALKING DOOR HINGE

BACKGROUND OF THE INVENTION

In modern building construction, especially lavatories in hospital rooms, it is desirable or even essential for a swingable door to be mounted so as to locate a vertical door surface immediately adjacent the vertical surface of a complementary door frame. Such door mountings provide an attractive appearance, afford considerable privacy, and act as effective sound, air or thermal barriers. Conventional door hinges cannot be effectively used in these installations in that they require that the door be spaced a distance from the door frame.

In such door installations which include a door of any appreciable thickness, it is necessary to horizontally move or walk the door member away from that vertical portion of the door frame which is adjacent the hinges, in order to permit free movement of the door from its closed position. It is desirable to provide hinges constructed so as to permit the door to swing open in either direction from a closed position. Horizontally disposed closure springs have previously been located within a door, but those arrangements have not been used with door displacing devices of the type described here. Door hinges which have met with commercial success in providing the desired door motion or opening action are disclosed and claimed in U.S. Pat. No. 3,895,412.

Among the important and general objects of the present invention is the provision of door hinge apparatus which provides the required door opening or action, and which can be constructed and offered at minimal cost. An ancillary object of the invention is to provide a door hinge or pivot assembly of this type which can be used to retain a door in a fully opened position. The door is urged toward its closed position from any intermediate or half-opened location.

The invention also contemplates that these door pivot assemblies can be installed by even relatively inexperienced personnel with a minimum amount of skill and effort.

Other objects and advantages of the invention will become apparent upon reading the following detailed descriptions and upon reference to the drawings. Throughout the drawings, like reference numerals refer to like parts.

BRIEF DESCRIPTION OF THE DRAWINGS

FIG. 1 is a perspective view showing a typical wall and floor within and upon which a typical door has been hung using the novel door pivot structure of the present invention;

FIG. 2 is a fragmentary perspective view showing one of the pivot units of the present invention;

FIG. 3 is a plan view showing in further detail the pivot unit of FIG. 2 as it appears when the door is in a closed position;

FIG. 4 is a plan view similar to FIG. 3 but showing the pivot unit as it appears when the door is in a partially opened position;

FIG. 5 is a fragmentary sectional view taken substantially in the plane of line 5—5 in FIG. 3 showing the parts as they appear when the door is in the closed position of FIG. 3;

FIG. 5A is a fragmentary sectional view similar to FIG. 5 but showing the device as it appears when the door is opened into the position of FIG. 4;

FIG. 6 is a plan view similar to FIGS. 3 and 4 showing the pivot unit as it appears when the door is in a fully opened position;

FIG. 7 is a sectional elevational view showing in detail the construction of a second pivot unit;

FIG. 8 is a sectional view taken substantially in the plane of line 8—8 in FIG. 7 showing the second pivot unit as it appears when the door is in its closed position;

FIG. 9 is a sectional view taken substantially in the plane of line 8—8 and similar to FIG. 8 but showing the second pivot unit as it appears when the door is in a partially opened position;

DETAILED DESCRIPTION

Figure 10:
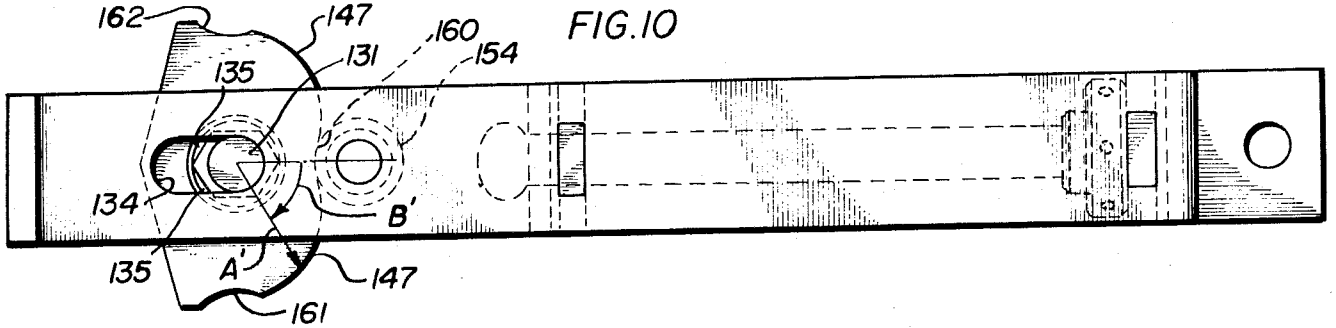
FIG. 10 is a sectional view similar to FIG. 9 but showing an alternate embodiment of the pivot unit.

While the invention will be described in connection with a preferred embodiment, it will be understood that it is not intended to limit the invention to this embodiment. On the contrary, it is intended to cover all alternatives, modifications and equivalents aa may be included within the spirit and scope of the invention.

Turning first to FIG. 1, there is shown a typical environment in which the invention may be used. Here, a door structure 10 is sized to fit within a doorway defined by a fixed floor 11 and a wall frame structure 12. It will be understood that the door 10 can, through the use of the present invention, swing outwardly away from the observer of FIG. 1 or inwardly toward the observer. The door 10 is defined in part by a vertical edge 14 which is located in relatively abutting relation to a vertical portion 15 of the fixed frame or wall 12 when the door 10 is in a closed position. However, since the door 10 is of appreciable thicknes as shown in FIG. 2, the door 10 and its vertical edge 14 are caused by the ivention to be located in a relatively spaced relation to the frame vertical portion 15 when the door structure 10 moves to an open position. Mounted at a bottom inner corner 18 of the door is a first pivot unit 19; at a top inner corner 20 of the door structure, a second pivot unit 21 is mounted. As illustrated, these first and second units 19 and 21 are also located adjacent the respective floor 11 and frame 12.

In accordance with one aspect of the invention, the first pivot unit 19 urges the door 10 into a closed position as illustrated in FIG. 1 and also moves the door and its inner edge 14 radially outwardly when the door is opened. To this end, the first unit 19 illustrated in FIGS. 2–6 inclusive comprises a plate 30 which is here affixed to the floor structure 11, as by screws or other known devices. Projectng from the floor plate 30 is a pintle 31 of noncircular cross-sectional aspect in its mediate region 32.

It will be noted that, when the door 10 is of a predetermined thickness, this pintle 31 is mounted at a predetermined distance X (see FIG. 3) from the frame structure vertical edge to permit appropriate clearance for the door swinging movement.

To provide the requisite motion for other parts of this hinge unit 19, a cam device 33 is affixed to the pintle in nonmoving relationship. Thus, in the illustrated embodiment, the floor plate 30, the pintle 31 and the cam 33 are all secured rigidly to the floor 11. In the illustrated embodiment, this cam device 33 takes the form of a number of parallel cam plates 34 and 35 separated by inner spacers 37.

A strap member 40 is affixed to the opposite structure — here, the door 10 — as by screws 41 or other convenient fasteners. The strap member 40 and the door 10 support a cam follower 43 which is urged against the cam 33 by a positive force biasing device 45 described in further detail below.

To move the door 10 radially outwardly of the pintle 31 as the door 10 swings angularly away from its closed position, the cam 33 and cam plates 34 and 35 are defined at least in part by a curved cam surface 47 generated by a genetrix B moves angularly away from the door structure closed position as illustrated in FIGS. 3 and 4. This cam surface genetrix A moves radially outwardly from the pintle 31 at a rate sufficient to cause that door edge 14 adjacent the vertical frame structure 15 to move outwardly so as to avoid crusing abuttive contact between the door 10 and the vertical frame structure 15.

To urge the door 10 toward its closed position as illustrated in FIG. 1 throughout a range of door partically opened positions, this first unit 19 increases the positive force of the biasing means 45 upon the cam follower member 43 as the door is opened. To this end, the biasing means 45 here comprises a bi-ended, elongate, resilient coil spring 50 through the center of which is carried a tie rod 51. An enlarged spherical head 52 located upon the inside of a yoke member 53 prevents radially outward motion of the tie rod 51. This yoke member 53, is, in turn, journalled upon the pintle 31 as particularly illustrated in FIG. 5. The outer strap member 40 is provided with elongated slots 55 which permit the strap 40 to move radially outwardly of the fixed pintle 31 as the strap 40 and the door 10 rotate angularly.

The condition of the elements of the first unit 19, when the door is in the open position, is shown in FIG. 5A. Here it can be seen that the yoke 53, pintle 31 and the rod 51 have not moved relative to each other. On the other hand, the strap 40 has moved to the right as viewed (compare FIGS. 5 and 5A). This movement is produced by the action of the cam 33 against the cam follower or plate 43. Also, this movement of the strap 40 is against the action of the spring 50, as will be explained. It should be noted that the strap 40 is affixed to the door 10, and as such, when said strap 40 moves relative to the pintle 33, the door 10 will also move outwardly of the pintle, and away from the door frame 15 to permint opening without the edge 14 of the door engaging said frame.

At the opposite end of the tie rod 51 is an adjustmemt nut 57 having a face 58 for abuttively engaging the spring 50. The nut 57 is also provided with female threads matable with tie rod male threads 59. This threaded connection permits the adjustment nut 57 to be located within a range of positions on the tie rod and, hence, adjust the biasing force applied by the coil spring 50.

Now since the yoke member 53, the tie rod 51 and the adjustment nut 57 are secured against radially outward motion, they undergo only angular motion as the door 10 is swung from its closed position to its opened position. However, since the strap member 19 is not so secured, it undergoes the radially outward motion caused by the cam 33 as well as angular motion when the door opens. A plate member 60, also secured to the strap member 40, abuts the spring 50 and likewise undergoes the radially outward and angular motion of the door and strap. Comparison of the relative motion of this plate 60 and the adjustment nut 57 will show that, as the door 10 opens, the interposed biasing spring 50 is compressed, that uncreasing the positive force applied to the cam follower 43 when the door 10 opens. This increase in force urges the door 10 toward its closed position throughout a range of door partially opened positions.

To resiliently maintain the door 10 in its closed position, the cam surface 47 includes a closed flat 63. To retain the door 10 in either of two opened positions, door open cam flats 64 are located upon opposite sides of the cam 33. In the illustrated embodiment, these opened positions are spaced at substantially 95° of door structure swing from the closed position, thereby providing a wide-open door configuration which will not cause damage to the door or require excessive radially outward door movement.

While the unit 19 will move or walk the lower edge of the door away from the frame, a second unit 21 is preferably employed to produce similar movement of the upper porton of door 10. Since sufficient biasing action is provided by the first or lower unit 19, the upper or second unit 21 need not be as structurally comprehensive as the lower or first unit 19, and preferably is of a constructon which can be provided at a low cost. To this end, the second pivot unit 21 illustrated in FIGS. 7–9 includes a pintle 70 which is secured, as by a base plate 71 and appropriate screws or other fasteners to one of the structure involved; here, this pintle 70 and base plate 71 are secured to the frame structure 12. Also, in the illustrated embodiment, a biasing spring 74 is provided to urge the pintle 70 into its projecting position as illustrated most particularly in FIG. 7. A pintle tip 76 is here formed having a noncircular cross-section end portion to which is affixed, in nonmoving relationship, a cam member 78.

It is a feature of the invention that radially outward motion of the door top corner 20 similar to or identical with the motion of the bottom door corner 18 is encouraged by this top or second unit 21. To this end, the cam 78 includes two diametrically opposed lobes 80 and 81 which are of differing chordal maximum width Y and Z, thus providing a somewhat arrowhead-shaped, bilobed cam 78 as illustrated particularly in FIGS. 8 and 9.

Affixed to the opposite structure (here, the door 10) is a cam follower plate 84. To cause the requisite door radially outward displacement or walking motion during door angular opening movement, the cam follower includes a surface 86 shaped to matingly accommodate the cam lobe 81 of greatest chordal width. A somewhat planar opposite cam follower surface 87 is provided with a tip 88 located abuttingly adjacent a cam surface tip 89 formed on the cam lobe 80 of minimum chordal width when the door 10 is in its closed position. When the cam and cam follower are shaped as illustrated in FIGS. 8 and 9 and as described here, the movement of the door 10 from the fully closed position to its partially opened positions produces radially outward relative motion between the cam 78 and pintle 70 on one hand and a cam follower 84 on the other hand to produce corresponding angular and radially outward motion of the door 10 relative to the frame 12 and floor 11. Again, the upper door corner 20 ans the door vertical edge 14 are moved or displaced from their relatively abutting position shown in FIG. 1 to a spaced apart position relative to the frame vertical structure 15 when the door is in its opened position.

Figure 11:
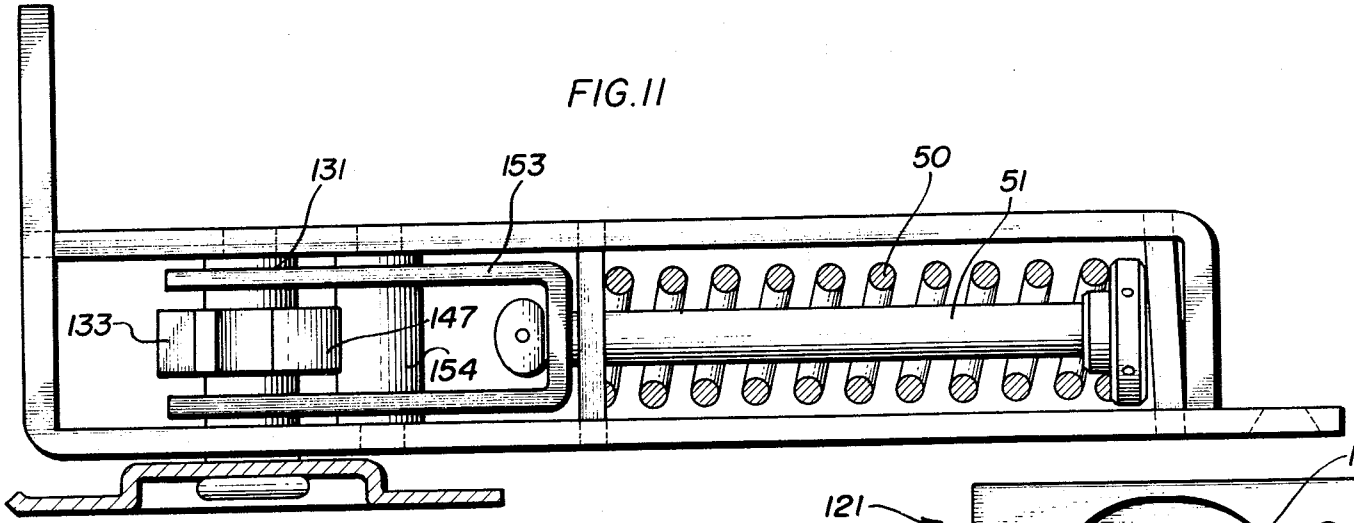
FIG. 11 is a sectional view similar to FIG. 5 but showing the alternate embodiment of FIG. 10.
Figure 12:
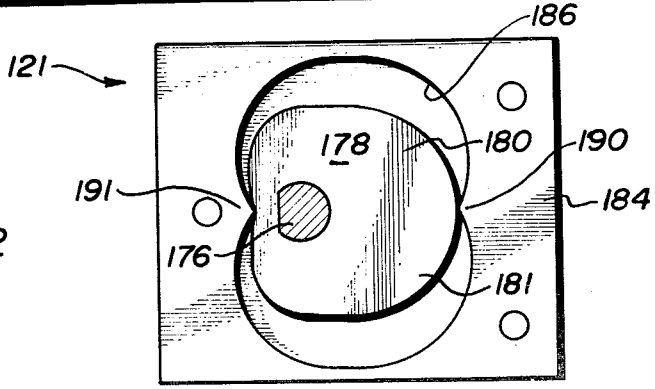
FIG. 12 is a sectional view similar to FIG. 8 but showing yet another embodiment of the pivot unit on an associated cam.

Another embodiment of the invention is shown in FIGS. 11 and 12. Here, a fixed pintle 131 secures a butterfly cam 133 against rotation by a center aperture 134 having flats 135 for engaging the pintle 131. Again, the cam 133 is defined at least in part by a curved cam surface 147 which is generated by a genetrix A′ which moves radially outwardly from the pintle 131 as a directrix B′ moved angularly away from the door structure closed postion as illustrated in FIG. 10. This cam surface genetrix A′ moves radially outwardly from the pintle 131 at a rate sufficient to cause the door adjacent the vertical frame structure to move outwardly so as to avoid crushing abuttive contact between the door and the vertical frame structure.

To ease door swinging motion and to minimize the opening torque required to be applied against the door and the hinge structure, a yoke 153 journals a cam follower roller 154 at a location for engaging the cam surface 147. This yoke 153 and cam follower 154 are urged into abuttive contact with the cam surface 147 by the spring 50 and tie rod 51, as described above.

A central indentation or detent 160 is formed in the cam surface 147 to encourage door retention in a door-closed position. Indentations or detents 161 and 162 are formed at opposite operating ends of the cam surface 147 to encourage door retention and door open locations or positions on either side of the doorway.

An alternate embodiment 121 of the second pivot unit is illustrated in FIG. 12. A pintle tip 176, formed so as to have a noncircular cross-section end portion, is affixed, in nonmoving relationship, to a cam member 178. Again, in accordance with the inventin, radially outward motion of the door top corner 20 (FIG. 1) is provided which is similar to or identical with motion of the door bottom corner 18 and is encouraged by this second unit 121. To this end, the cam 178 includes two diametrically opposed lobes 180 and 181. Affixed to the opposite door structure is a cam follower plate 184, within which the cam 178 fits. This cam follower plate 184 includes a female surface 186 shaped to matingly accommodate the cam lobes 180 and 181. Cam follower surface tips 190 and 191 engage the cam 180 and force the door to undergo its outward walking motion as the door is pivoted into an open position, as described above.

While the present invention has been discussed with regard to the embodiment illustrated in the drawings, it is to be understood and is indeed contemplated that many variations may be employed without departing from the spirit and scope of the invention. In this regard, spring biased units may be employed at both the top and bottom portions of the door. Alternatively, where the conditions allow, only cam-type units similar to the second units 21 need be employed.

The invention is claimed as follows:

1. Door pivot mechanism for use with a door structure sized to fit within a space defined by a fixed floor and frame structure, the door structure having a vertical edge in relatively juxtaposed relation to a vertical portion of the fixed frame structure when the door structure is in a closed position and in a relatively spaced apart relation to the frame vertical portion when the door structure is in an open position, said door pivot mechanism including first and second units mounted at top and bottom inner door structure corners and adjacent frame and floor structure, the first unit comprising a pintle, means for affixing the pintle to one of the structures in nonmoving relationship, a cam affixed to the pintle in nonmoving relationship therewith, the cam being at least partially defined by a curved cam surface generated by a genetrix which moves radially outwardly from the pintle as a directrix moves angularly away from the door structure closed position, a cam follower carried by the other structure, positive force biasing means urging the cam follower into abuttive contact with the cam such that upon opening movement, relative movement is produced between said cam and said cam follower, for increasing the positive force of the biasing means to urge the door structure toward its closed position throughout a range of door structure partially opened positions and also to space said door structure from the frame, and the second unit comprising a pintle, means for affixing the pintle to one of the structures in nonmoving relationship, a cam affixed to the pintle in non-moving relationship, the cam including a plurality of lobes, and a cam follower affixed to the other structure in nonmoving relationship, the cam and cam follower having mutually engaging surfaces such that movement of the door structure from the fully closed position through its partially opened positions produces radially outward motion of the cam and pintle and relative to the cam follower and corresponding motion of the door structure relative to the frame and floor structure, the first and second units thus causing the door structure vertical edge to displace from the relatively juxtaposed position adjacent the frame structure vertical portion when the door is in its closed position to it relatively spaced apart position relative to the frame structure vertical portion when the door is in its open position.

2. Door pivot mechanism according to claim 1 including bi-ended resilient means, a tie rod member, an adjustment nut member carried at one end of the tie rod member and adapted to abuttively engage one end of the resilient means, a yoke member connected to the tie rod member pintle to cause the tie rod member and adjustment nut member to move angularly but nonradially relative to said pintle as the door structure is opened, and a plate member abutting the other end of the resilient means and connected to the cam follower means to move both angularly and radially outwardly relative to said pintle with the cam follower means and the door structure as the door structure opens, the difference in motion of the yoke member and plate member thus altering the shape of the resilient means and increasing the positive force of the biasing means on the cam follower member as the door structure opens.

3. A door pivot mechanism according to claim 2 wherein said adjustment nut member is provided with female threads and said tie rod member is provided with mating male threads to permit the adjustment nut member to be located on the tie rod member in any one of a number of positions whereby to adjust the compressive force exerted upon said resilient means.

4. Door pivot mechanism according to claim 1 wherein said first unit cam member is provided with at least one cam surface flat adapted to engage the first unit cam follower member and retain the door structure in an open position.

5. Door pivot mechanism according to claim 4 including two cam follower flats located upon opposite sides of the cam to retain the door structure in either of two opened positions.

6. Door pivot mechanism according to claim 5 wherein each open position cam follower flat is spaced substantially 95° of door structure swing from the door structure closed position.

7. Door pivot mechanism according to claim 1 wherein said first unit cam member is provided with at least one cam surface detent adapted to engage the first unit cam follower and retain the door structure in an open position.

8. Door pivot mechanism according to claim 7 including two cam follower detents located upon opposite sides of the cam to retain the door structure in either of two opened positions.

9. Door pivot mechanism according to claim 1 wherein said first unit cam member is provided with a door-structure-closed flat adapted for engagement by said first unit cam follower, the closed flat being adapted to retentively urge said door structure into its door closed position.

10. Door pivot mechanism according to claim 1 wherein said first unit cam is provided with a door-structure-closed detent for engagement by said first unit cam follower, the closed detent being adapted to retentively urge said door structure into its door closed position.

11. Door pivot mechanism according to claim 1 wherein the door structure is of a predetermined thickness and said first unit pintle is mounted at a predetermined distance from the frame structure vertical edge, the mechanism including a first unit cam formed by a cam surface genetrix which has moved radially outwardly from the pintle, during cam surface generation, at a rate sufficient to cause that door edge adjacent the vertical frame structure to move outwardly so as to avoid crushing abuttive contact between the door structure and the vertical frame structure.

12. Door pivot mechanism according to claim 1 wherein said pintles of the first and second units are affixed to the frame and floor structure and wherein said cam followers are affixed to the door structures for motion therewith.

13. Door pivot mechanism according to claim 1 wherein said second unit includes a cam having at least two lobes disposed diametrically opposite one another but of differing chordal widths, and wherein sad second unit cam follower includes a recess shaped to nestingly accommodate the cam lobe of greatest chordal width.

14. Door pivot structure according to claim 13 wherein said cam follower structure includes a surface having a protruding tip, and a cam lobe of least chordal width including a tip located for abutment against the cam follower surface tip when the door structure is in its closed position.

15. Door pivot mechanism for a door structure sized to fit within a space defined by a fixed floor and frame structure, the door structure having a vertical edge in relatively juxtaposed relation to a vertical portion of the fixed floor and frame structure when the door structure is in a closed postion and in a relatively spaced apart relation to the frame vertical portion when the door structure is in an open position, the door pivot mechanism including first and second units mounted at top and bottom inner door structure corners and adjacent floor and frame structure, the first unit comprising a pintle, means for affixing the pintle to one of the structures in nonmoving relationship, a cam affixed to the pintle in nonmoving relationship therewith, the cam being at least partly defined by a smoothly curved nonlobular cam surface, a cam follower carried by the other structure, biasing means for urging the cam follower into engagement with the cam, the cam having a cam surface such that the biasing means also urges the cam follower to travel along the cam surface into a door closed position, and the second unit comprising a pintle, means for affixing the pintle to one of the structures in nonmoving relationship, a cam affixed to the structure in nonmoving relationship, the cam including a plurality of diametrically opposed lobes and a cam follower affixed to the other structure, the cam and cam follower having mutually engaging surfaces such that movement of the door structure from the fully closed position through its partially opened positions produces radially outward relative motion of corresponding cam and pintle and the cam follower and cooresponding angular and radially outward motion of the door relative to the frame and floor structure, both said units causing the door structure vertical edge to displace from the relatively abutting position adjacent the frame structure vertical portion when the door structure is in its closed position to its relatively spaced apart position relative to the frame structure vertical portion when the door structure is in its open position.

16. Door pivot mechanism according to claim 15 wherein said cam follower structure includes a surface having a protruding tip and wherein said cam has a lobe of greatest chordal width and a cam lobe of least chordal width and including a tip, the cam follower surface tip being located abuttingly adjacent the cam surface tip when the door structure is in its closed position.

17. Door pivot mechanism according to claim 16 wherein said second unit includes a cam follower having a recess shaped to matingly accommodate the cam lobe of greatest chordal width.

18. Door pivot mechanism according to claim 15 including pintle means affixed to the second unit cam member in nonmoving relationship, and means for affixing the second unit pintle to one of the structures in a nonmoving relationship.

19. Door pivot mechanism according to claim 15 including a tie rod member extending through said biasing means and an adjustment nut member threaded upon the tie rod member for adjusting the amount of biasing force applied by the biasing means to the cam follower and cam.

20. a door pivot mechanism for use with a door structure fixed to fit within a space defined by a fixed floor and door frame structure, the door structure having a vertical edge in relatively juxtaposed relation to a vertical portion of the frame structure when the door is in a closed position and a relatively spaced apart relation when the door is in the open position, a door pivot mechanism including a pintle adatped to be affixed to one of said structures in stationary relation thereto, said pintle having cam means mounted thereon, a strap member affixed to said other structure and providing a cam follower means for engagement with said cam means, biasing means maintaining said cam follower means in contact with said cam means, such that upon opening movement of said door relative movement between said cam means and said strap member is produced causing said door to move away from said frame so that the edge portions of said door will not engage the vertical portion of said frame during opening movement.

21. Door pivot mechanism according to claim 20 wherein said biasing means is a biended resilient means, and there is further included a tie rod member, an adjustment nut member carried at one end of the tie rod member and adapted to abuttively engage one end of the tie rod member and adapted to abuttively engage one end of the resilient means, yoke means connected to the tie rod member to cause the tie rod member and adjustment nut member to move angularly but nonradially relative to said pintle, and a plate member on said strap member abutting the other end of the resilient means to move both angularly and radially outwardly relative to said pintle with the strap member as the yoke means moves, the difference in motion of the yoke member and the plate member thus altering the shape of the resilient means and increasing the positive force of the biasing means on the cam follower means as the cam follower means is moved angularly away from the door closed position.

22. A door pivot mechanism according to claim 21 wherein said adjustment nut member is provided with female threads and said tie rod member is provided with mating male threads to permit the adjustment nut member to be located on the tie rod member in any one of a number of positions whereby to adjust the compressive force exerted upon said resilient means.

23. Door pivot mechanism according to claim 20 wherein said cam member is provided with at least one cam surface flat adapted to engage the first unit cam follower member and retain the door structure in an open position.

24. Door pivot mechanism according to claim 23 including two cam follower flats located upon opposite sides of the cam to retain the door structure in either of two opened positions.

25. Door pivot mechanism according to claim 23 wherein each open position cam follower flat is spaced substantially 95° of angular motion from the door closed flat.

26. Door pivot mechanism according to claim 20 wherein said cam member is provided with at least one cam surface detent adapted to engage a first unit cam follower roller and retain the door structure in an open position.

27. Door pivot mechanism according to claim 26 including two cam follower detents located upon opposite side of the cam to retain the door structure in either of two opened positions.

28. Door pivot mechanism comprising a pintle, a cam affixed to the pintle in nonmoving relationship, the cam including two diametrically opposed lobes and a cam follower having a recess shaped to matingly accommodate one cam lobe, the cam and cam follower having mutually engaging surfaces such that angular motion of the cam follower relative to the cam follower produces radially outward relative motion of the cam and pintle relative to the cam follower and corresponding angular and radially outward motion of a door relative to a frame and floor structure.

29. Door pivot mechanism according to claim 28 wherein said cam follower structure includes a surface having a protruding tip and wherein said cam lobe of least chordal width includes a tip, the cam follower surface tip being located abuttingly adjacent the cam surface tip when the cam and cam follower are relatively located in a door-closed position.

* * * * *

UNITED STATES PATENT AND TRADEMARK OFFICE

CERTIFICATE OF CORRECTION

PATENT NO. : 4,000,540

DATED : January 4, 1977

INVENTOR(S) : ROBERT L. NEWLON

It is certified that error appears in the above-identified patent and that said Letters Patent are hereby corrected as shown below:

Col. 2, line 44, "ivention" should be --invention--
Col. 2, line 59, "Projectng" should be --Projecting--
Col. 3, line 17, after "genetrix" insert --A which moves radially outwardly from the pintle 31 as directrix--
Col. 3, line 22, "crusing" should be --crushing--

Col. 3, line 53, "permint" should be --permit--
Col. 4, line 9, "that uncreasing" should be --thus increasing--
Col. 4, line 35, "structure" should be --structures--
Col. 5, line 2, "ans" should be --and--
Col. 5, line 38, "inventin" should be --invention--
Col. 6, line 44, after "member" 1st occurrence, insert -- and --.
Col. 7, line 44, "structures" should be --structure--
Col. 7, line 49, "sad" should be --said--
Col. 8, line 20, change "corresponding" to --the--
Col. 8, line 21, "cooresponding" should be --corresponding--
Col. 8, line 59, "adatped" should be --adapted--
Col. 10, line 16, "side" should be --sides--
Col. 10, line 24, after "cam" delete --follower--

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*